US005343625A

United States Patent [19]

Chen et al.

[11] Patent Number: 5,343,625

[45] Date of Patent: Sep. 6, 1994

[54] PORTABLE MAGNETIC DRAFTING BOARD

[76] Inventors: Chiang M. Chen; Kun M. Chen, both of No. 3, Lane 50 Chung Nan, Kuang Hsing Rd., Taiping Hsiang, Taichung Hsien, Taiwan

[21] Appl. No.: 981,505

[22] Filed: Nov. 25, 1992

[51] Int. Cl.[5] ..... B43L 13/02

[52] U.S. Cl. ..... 33/403; 33/430; 33/DIG. 1

[58] Field of Search ..... 108/1, 23, 25, 161; 248/133, 188.4, 454–456, 461; 40/600; 312/231; 33/403, 430, 438, DIG. 1, 432, 434

[56] References Cited

U.S. PATENT DOCUMENTS

| | | | |
|---|---|---|---|
| 2,763,241 | 9/1956 | Waggoner | 33/DIG. 1 X |
| 3,093,919 | 6/1963 | Holtz | 33/DIG. 1 X |
| 3,332,399 | 7/1967 | Patrick et al. | 248/441.1 |
| 3,672,062 | 6/1972 | Baker | 33/DIG. 1 X |
| 3,746,992 | 7/1973 | Serembe | 33/DIG. 1 X |
| 4,138,818 | 2/1979 | Hebel | 33/DIG. 1 X |
| 4,146,976 | 4/1979 | Zambiasi | 40/600 X |
| 4,611,406 | 9/1986 | Engstrom et al. | 33/430 X |
| 4,654,762 | 3/1987 | Lauerick | 312/231 X |
| 4,934,061 | 6/1990 | Knight et al. | 33/DIG. 1 X |
| 5,012,586 | 5/1991 | Ashworth | 33/DIG. 1 X |

*Primary Examiner*—Clifford D. Crowder
*Assistant Examiner*—Ismael Izaguirre
*Attorney, Agent, or Firm*—Gunn, Lee & Miller

[57] ABSTRACT

A drafting board includes a base, a shoulder formed in the perimeter of the upper surface of the base, a magnetic board engaged in the shoulder of the base, two holes formed in the bottom surface of the base, and a rod engaged in each of the holes of the base for elevating the upper edge of the base. The upper edge is located higher than the lower edge and the base is supported by the rods in a sloped fashion.

3 Claims, 2 Drawing Sheets

PORTABLE MAGNETIC DRAFTING BOARD

BACKGROUND OF THE INVENTION

1. Field of the Invention

The present invention relates to a drafting board, and more particularly to a portable drafting board.

2. Description of the Prior Art

A typical drafting table occupies a large volume and has a heavy weight and is not portable.

The present invention has arisen to mitigate and/or obviate the afore-described disadvantages of the conventional drafting tables.

SUMMARY OF THE INVENTION

The primary objective of the present invention is to provide a portable drafting board with which the users may draft easily and comfortably.

In accordance with one aspect of the invention, there is provided a drafting board comprising a base including an upper edge and a lower edge and including an upper surface and a bottom surface, a shoulder formed in the upper surface of the base and formed along the perimeter of the upper surface, a magnetic board engaged in the shoulder of the base, two holes formed in the bottom surface of the base, and a rod engaged in each of the holes of the base for elevating the upper edge of the base, whereby, the upper edge is located higher than the lower edge and the base is supported by the rods in a sloped fashion.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
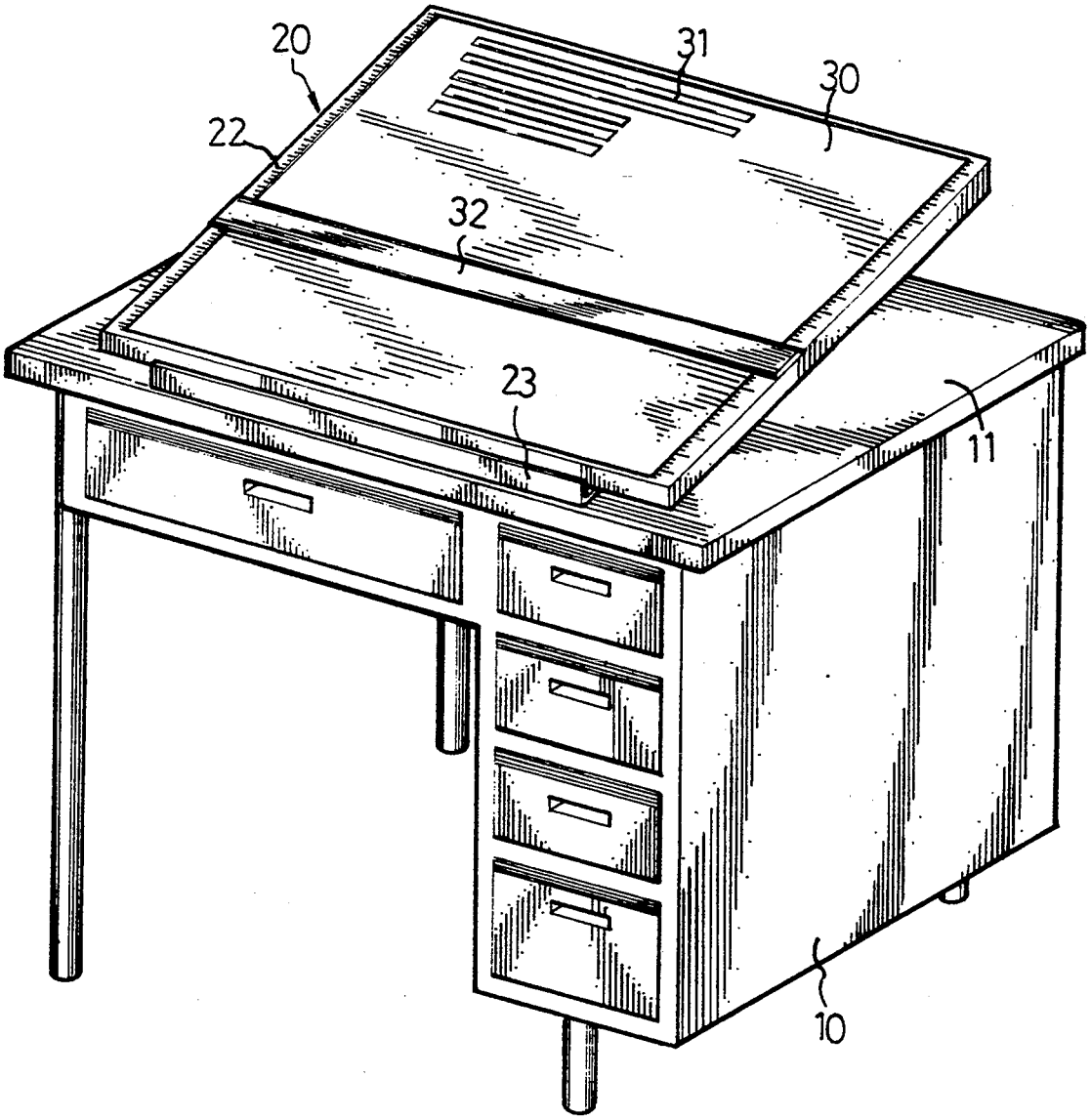
FIG. 1 is a perspective view of a drafting board in accordance with the present invention which is disposed on a table.
Figure 2:
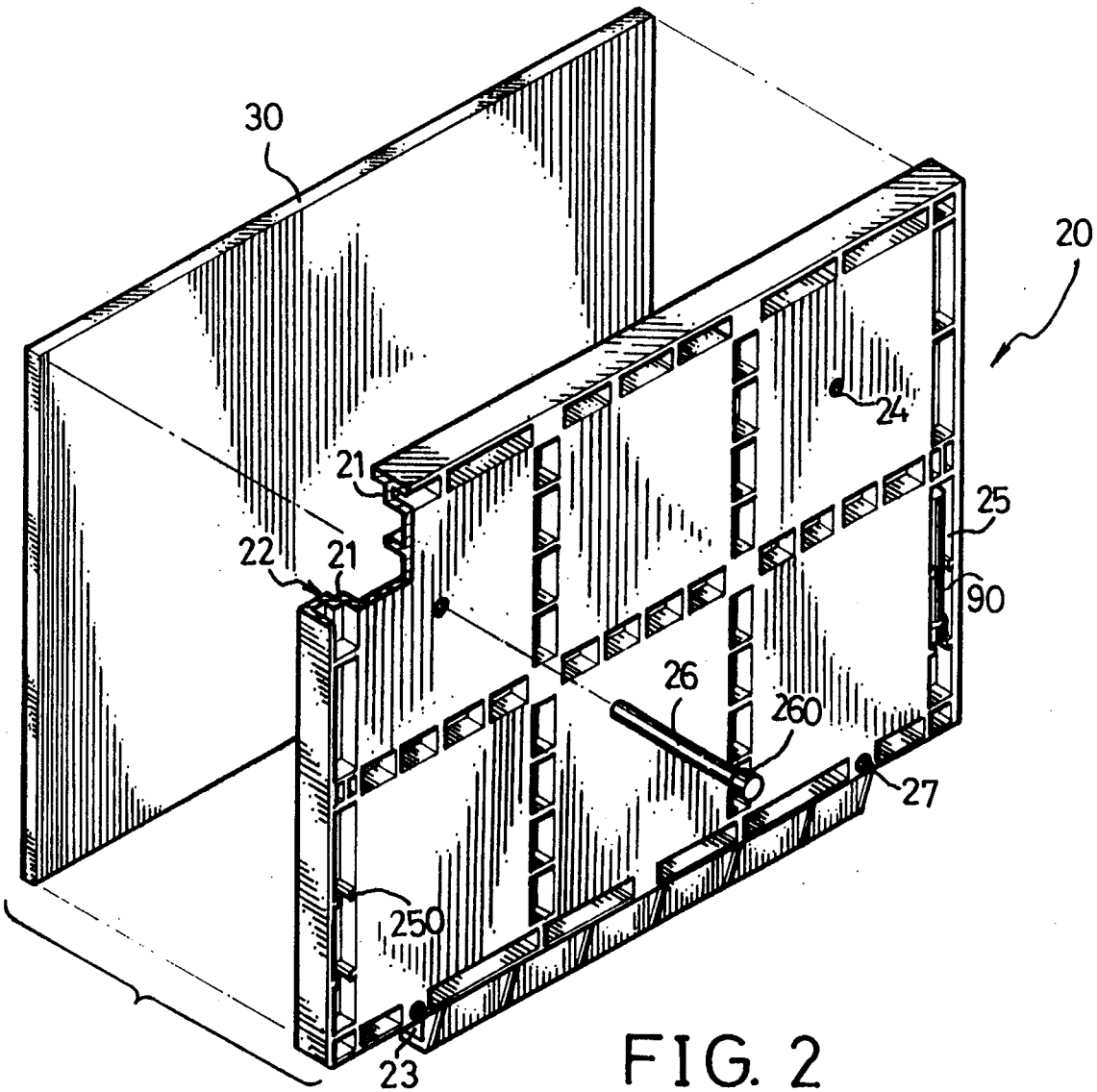
FIG. 2 is an exploded view of the drafting board, and is seen from the bottom portion of the drafting board.

Referring to the drawings, a drafting board in accordance with the present invention is portable and can be disposed on a table surface 11 of a table 10. The portable drafting board comprises a base 20 which is preferably formed by molding processes, the base 20 includes a shoulder 21 formed along the perimeter 22 of the upper surface thereof such that the perimeter 22 is formed as a protruded wall member 22, a magnetic board 30 is received and engaged in the shoulder 21 of the base 20 and preferably has a thickness equal to the depth of the shoulder 21 such that the magnetic board 30 is flush with the wall member 22 of the base 20, best shown in FIG. 1. An L-shaped bar 23 is formed integral on one side, particularly the lower side of the base 20 (which will be discussed hereinafter), and is provided for receiving objects, such as pencils, rubber bands, rulers, knives etc. At least one strip 31 and a ruler 32 which are preferably made of metal materials can be attracted by the magnetic board 30, the strips 31 and the ruler are movable on the magnetic board 30.

A groove 25 is formed in the perimeter of the bottom surface of the base 20 corresponding to the protruded wall member 22 of the base 20 for receiving drafting pens 90 and the like. At least one pair of ribs 250 are formed within the groove 25 for engagement with the drafting pens 90 so as to retain the drafting pens in place. A pair of pads 27 are formed in the bottom surface of the base 20 close to the bar 23, i.e., close to the lower side of the base 20, and two holes 24 are formed in the bottom surface of the base 20 distal from the pads 27, a rod 26 is engaged in each of the holes 24 and includes an enlarged head 260 for contacting the table surface 11.

As shown in FIG. 1, when the rods 26 are engaged in the holes 24 of the base 20 and when the drafting board is supported on the table surface 11 by the rods 26 and the pads 27, the edge or the side where the bar 23 forms integral therewith forms the lower edge or the lower side, such that the pads 27 contact the table surface 11 and the bar 23 is located in the lower side or lower edge of the base 20, the upper edge which is opposite to the lower edge of the base 20 is elevated by the rods 26 such that the drafting board is supported on the table surface 11 with a suitable slope, the slope can be adjusted by changing the rods 26 with different lengths.

A graduation is preferably provided on the protruded wall member 22, such that parallel lines can be easily drafted with the ruler 32 when the ruler 32 is aligned with the graduation.

Accordingly, the drafting board in accordance with the present invention includes a simple configuration and has a light weight which is good for portable purposes. The drafting board can be supported on a table surface with a suitable slope.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A drafting board comprising a base including an upper edge and a lower edge and including an upper surface and a bottom surface, a shoulder formed in said upper surface of said base and formed along the perimeter of said upper surface, a magnetic board mounted in said shoulder of said base, said shoulder having a depth, and said magnetic board having a thickness equal to said depth of said shoulder such that said magnetic board is flush with said base, a ruler being attracted by said magnetic board and movable on said magnetic board, two holes formed in said bottom surface of said base, and a rod engaged in each of said holes of said base for elevating said upper edge of said base, whereby, said upper edge is located higher than said lower edge such that said base is supported by said rods in a sloped fashion.

2. A drafting board according to claim 1, wherein a groove is formed in the perimeter of said bottom surface of said base for receiving objects, and at least one pair of ribs are formed in said groove for engagement with said objects and for retaining said objects in place.

3. A drafting board according to claim 1, wherein said base further includes a bar integrally formed on said lower edge of said base for receiving objects.

* * * * *